United States Patent [19]

Ball

[11] 3,968,656

[45] July 13, 1976

[54] METHOD OF WORKING UNDERWATER

[75] Inventor: Kenneth Ball, Hightown, England

[73] Assignee: Intertek Technical Services Limited, Liverpool, England

[22] Filed: Apr. 1, 1974

[21] Appl. No.: 456,769

[52] U.S. Cl. .....61/69 R; 166/0.5

[51] Int. Cl.[2] .....B63C 11/36

[58] Field of Search .....61/69 R, 69 A, 72.3; 114/16 R, 16.4, 16.8; 166/0.5, 0.6

[56] References Cited

UNITED STATES PATENTS

| | | | |
|---|---|---|---|
| 3,473338 | 10/1969 | Pearce | 61/69R |
| 3,512,583 | 5/1970 | James | 166/0.5 |
| 3,548,516 | 12/1970 | Lanphier et al | 61/69.RX |
| 3,625,171 | 12/1971 | Bailey | 114/16.R |

*Primary Examiner*—Paul R. Gilliam
*Assistant Examiner*—David H. Corbin
*Attorney, Agent, or Firm*—Scrivener, Parker, Scrivener and Clarke

ABSTRACT

Unlike prior proposals of working underwater, the underwater installation is enclosed in a water-filled capsule or at least when a transit capsule is in place there is such a water-filled capsule. Instead of pumping out the installation part capsule, it is merely reduced in pressure to protect the personnel from the bends; the presence of the water is advantageous from a safety point of view and gives operational advantages.

5 Claims, 9 Drawing Figures

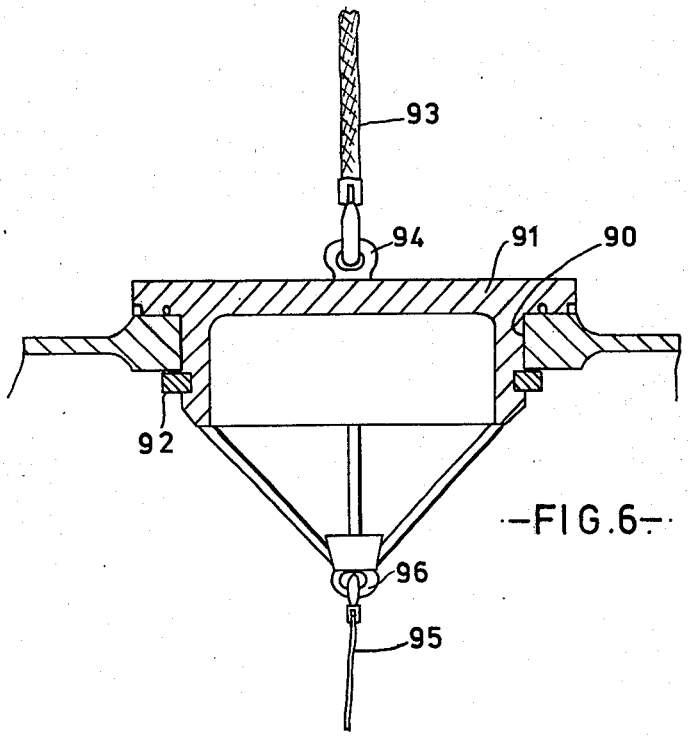
—FIG.6—
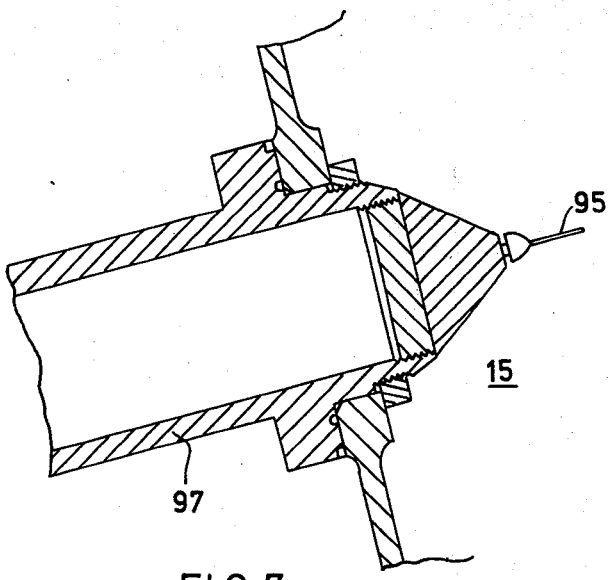
—FIG.7—

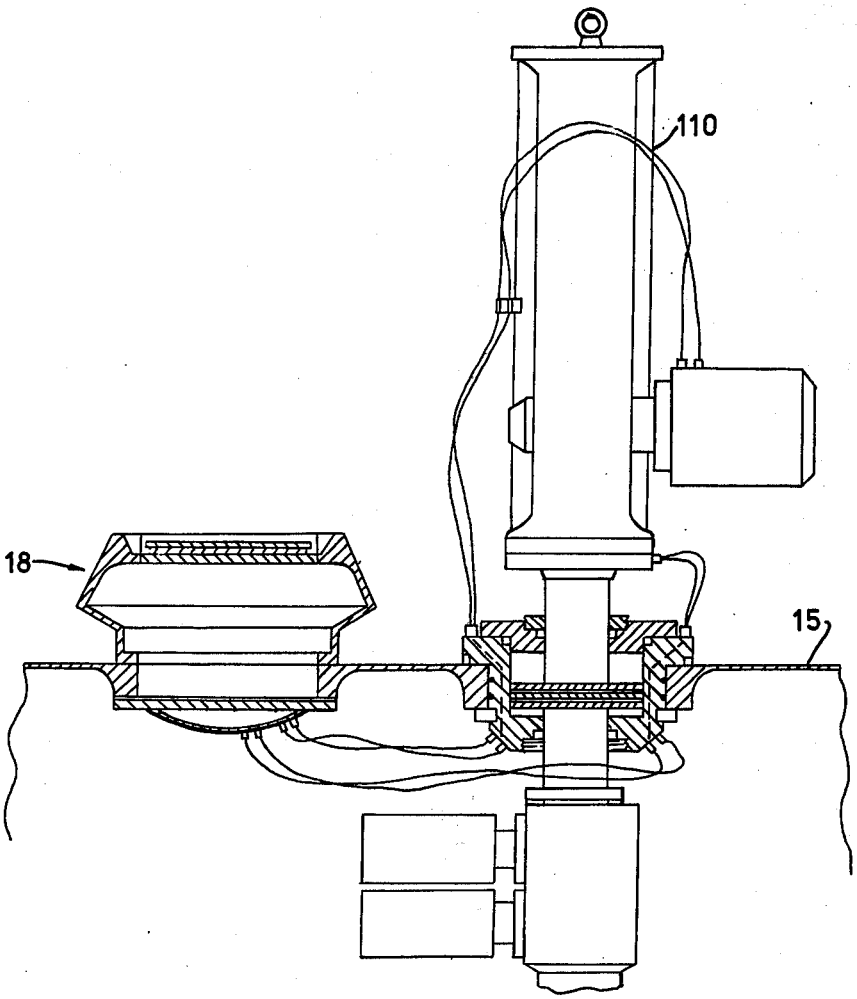
—FIG.8.—

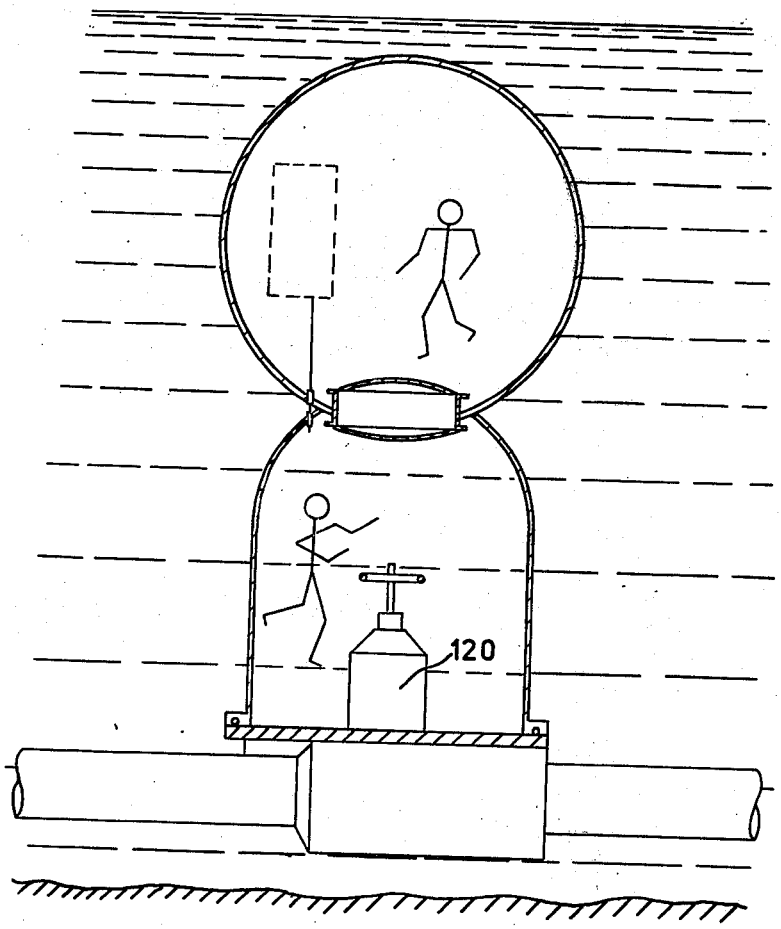
—FIG. 9.—

METHOD FOR WORKING UNDERWATER

The present invention concerns a method of working underwater and apparatus therefor.

There is a problem in working underwater on the erection and maintenance of seabed installations such as oil well heads. With conventional diving and diving-bell techniques, the personnel are subject to the hydrostatic pressure head corresponding to the water depth and, due to the need to decompress to avoid the bends, their working day is very short. It has been proposed to enclose parts of the seabed installation within capsules filled with air or another gas at atmospheric pressure and to bring the personnel down to such capsules within other capsules filled with air at atmospheric pressure; the transfer of personnel involved having mating means on the capsules which formed water-filled conjunction capsules which had to be pumped out or drained into the installation part capsules (which in turn had to be pumped out) and filled with air at atmospheric pressure. This pumping involved the transfer of large volumes of water equal to the volumes of the conjunction capsules against the full hydrostatic pressure head. This pumping out is a heavy duty pumping requirement and involves large amounts of power and is time consuming. It is difficult to make the transit capsule self-sufficient and it is necessary to supply the power from surface support ships. Any parts to be installed must be transported within the transit capsules or so as to be within the conjunction capsules; the alternative is to flood the installation part capsules which then have to be pumped out again. Whenever a pipe or electrical connection has to be made through a wall of an installation part capsule it is necessary to flood the capsule and subsequently pump it out or use elaborate lock-through arrangements.

Also any leakage of oil tends to collect in the bottoms of the installation part capsules with the result that if the installation part capsules are subsequently flooded the oil smears itself over the installation part. Moreover if a leak occurs when men are inside an installation part capsule the leak takes the form of a high pressure jet of seawater.

In the subsequent parts of this specification, atmospheric pressure means any pressure accepted by medical opinion as safe for working without the need for lengthy decompression and typically includes up to a pressure corresponding to 10 meters less the depth of water in the capsules.

According to the present invention in one of its aspects, a method of working underwater comprises descending in an air-filled transit capsule at atmospheric pressure to a part of an underwater installation on which a function is to be performed and which is at a depth where the external pressure is greater than safe for working without the need for lengthy decompression, joining the capsule to said installation part so as to have two capsules, the transit capsule filled with air at atmospheric pressure and another capsule initially filled with water at the external pressure, reducing the pressure of the water in said other capsule to atmospheric pressure, gaining access to, and performing the desired function on, the installation part whilst it is immersed in water at atmospheric pressure, returning to the transit capsule, repressurizing said other capsule and returning to the surface.

Whilst it is possible to have said other capsule contain the installation part, it is preferred to have a permanently water-filled capsule enclosing the installation part and to form said other capsule as a conjunction capsule through which access is gained to the installation part capsule.

Therefore in accordance with another aspect of the present invention, a method of working underwater comprises descending in an air-filled transit capsule to a water-filled capsule enclosing a part of an underwater installation on which a function is to be performed, joining the two capsules and so forming a third, conjunction, capsule establishing the pressure in the conjunction and installation part capsules at atmospheric, gaining access to, and performing the desired function on, the installation part whilst its capsule is filled with water at atmospheric pressure, returning to the transit capsule and returning to the surface.

Whilst if there is a conjunction capsule it is possible to leave the installation part capsule at atmospheric pressure, it is preferred that normally all water filled capsules are at external pressure when the transit capsule is absent.

Since water is substantially incompressible, the amount of water transfer for reducing the pressure from external to atmospheric is small and can be dealt with even by the normal ballast adjusting pumps of a submersible, by which is meant a self-contained vessel like a small submarine. In fact no pump is strictly necessary since the pressure can be vented into the transit capsule and repressurization achieved by connection to the external sea. However the size and weight of a pump to transfer the samll amount of water involved do not involve an excessive penalty unlike the heavy duty high-volume pumps which would be necessary for pumping out a capsule and does allow the transit capsule to have its buoyancy adjusted to give additional safety.

A further aspect of the present invention provides a transit capsule for transporting personnel to a part of an underwater installation on which a function is to be performed characterized by the provision of shallow water diving support means and by means for forming a sealed capsule in cooperation with the installation part within which the shallow water diving support means can be used irrespective of the actual depth.

A yet further aspect of the present invention provides a part of a seabed installation enclosed in a capsule characterized in that the capsule is adapted to be water-filled when in service.

As examples of features which would betray that the capsule was adapted to be water-filled, attention is drawn to valves for relieving excess pressures in the capsule and oil detecting means in the upper part of the capsule.

Embodiments of the invention will now be described, by way of example, with reference to the accompanying drawings.

THE DRAWINGS

Figure 3:
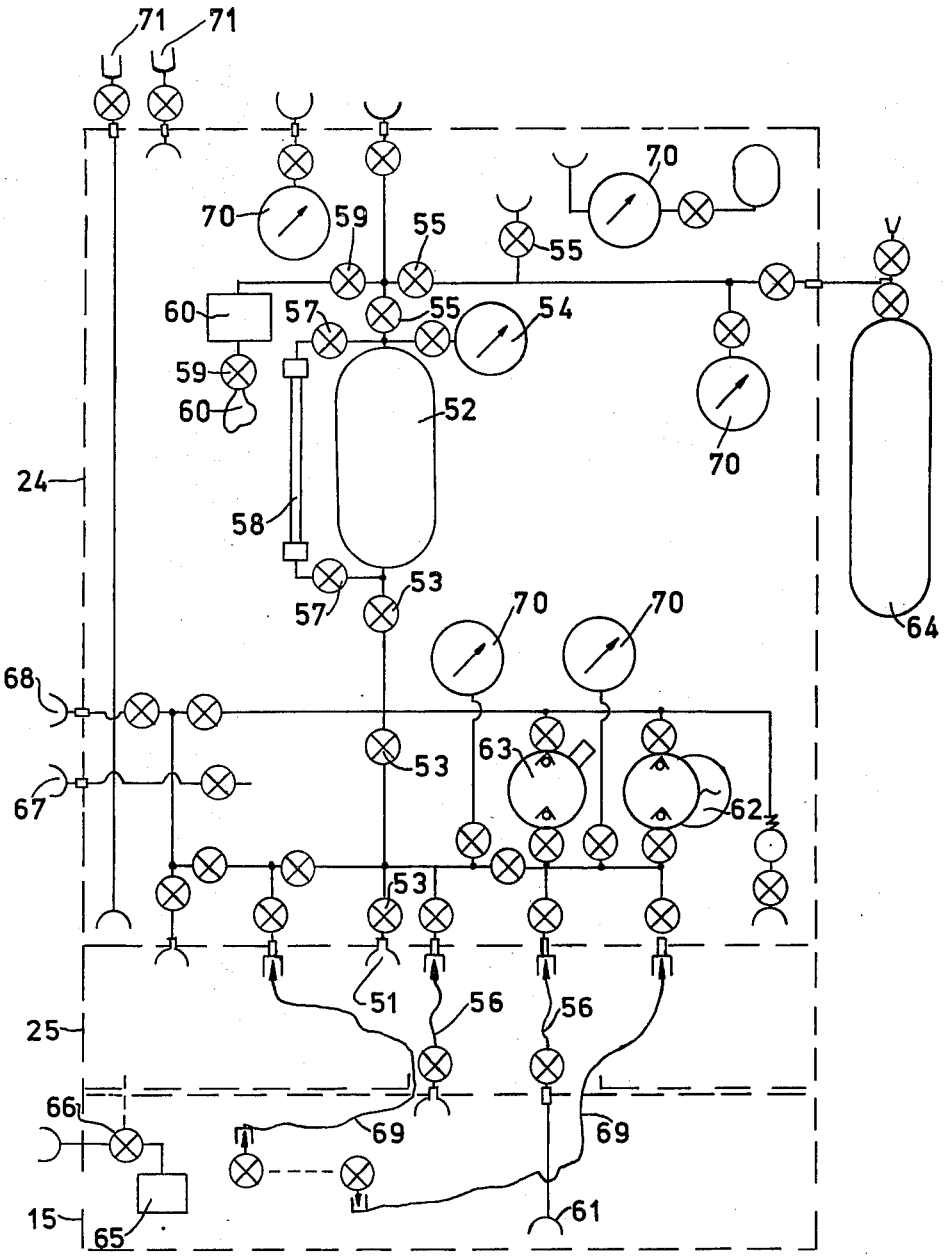
Figure 4:
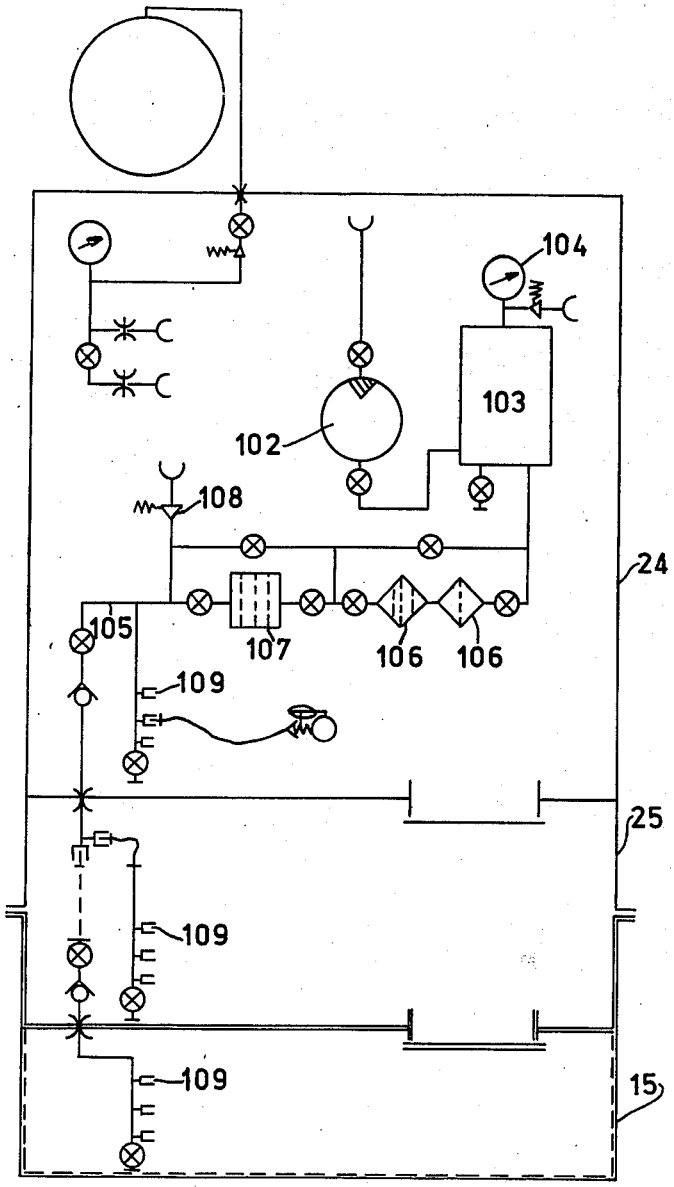
Figure 5:
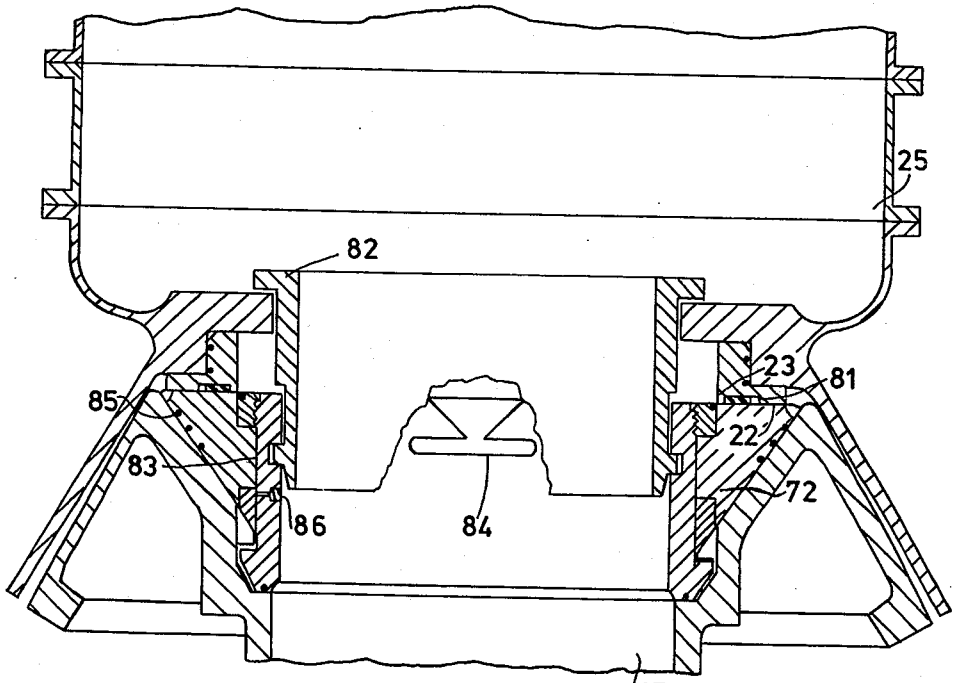

FIG. 3 is a schematic circuit diagram showing means for regulating water pressure in various schematically shown capsules, FIG. 4 is a schematic circuit diagram of a preferred arrangement for providing a breathing supply to personnel working within the installation part capsule, FIG. 5 shows means for effecting a seal between the transit capsule and the installation part capsule together with means for testing and maintaining the seal, FIG. 6 shows a removable cover plate in the wall of the installation part capsule, FIG. 7 shows means for connecting auxiliary equipment through the wall of the installation part capsule and sealing thereto, FIG. 8 shows an external unit fitted to the installation part capsule, and FIG. 9 illustrates a simplified second version of the invention.

DETAILED DESCRIPTION OF THE EMBODIMENTS

Figure 1:
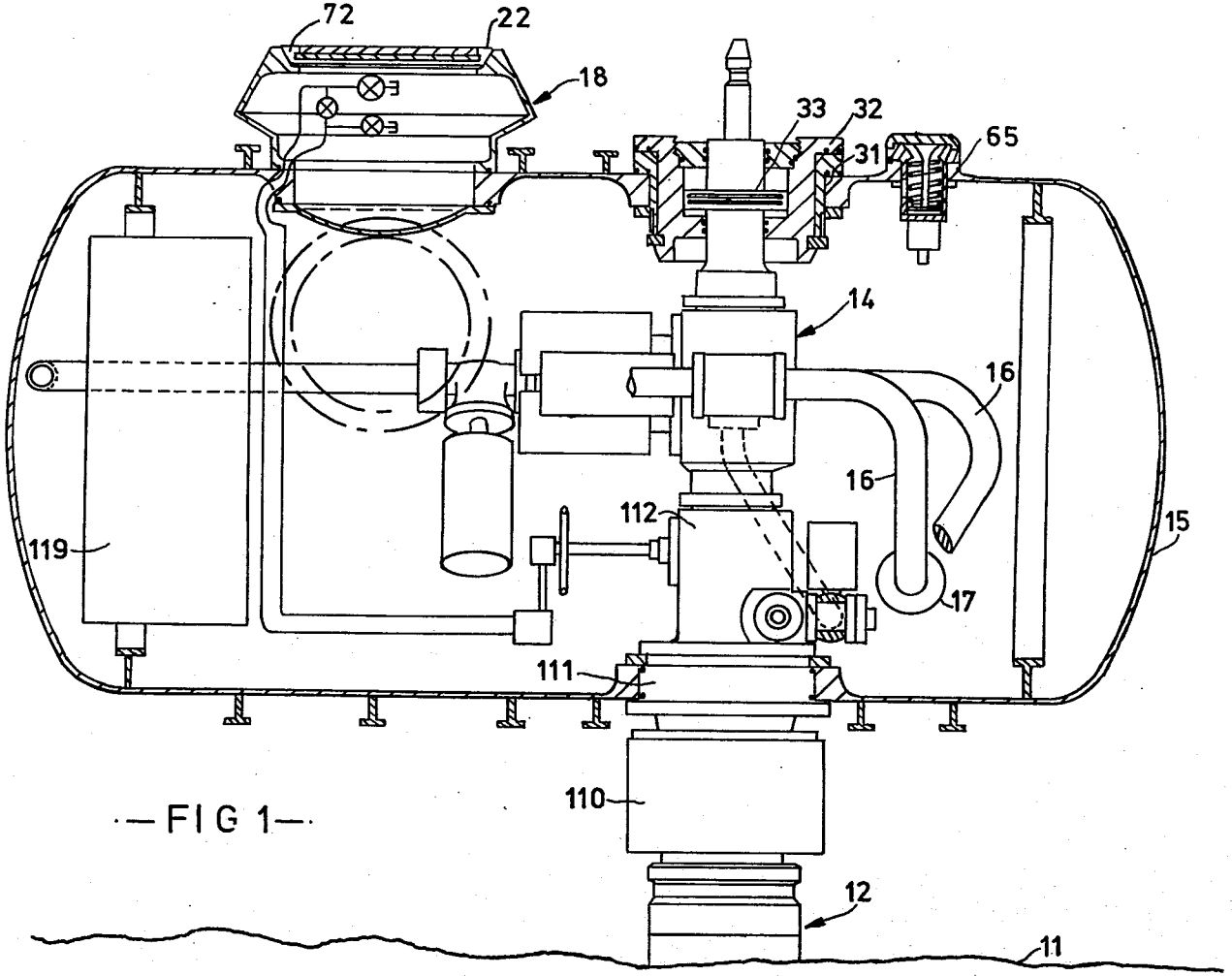
FIG. 1 shows part of a seabed installation enclosed in a capsule.

FIG. 1 shows a portion of a seabed 11 from which projects the well head casings 12. On the casings is mounted a christmas tree 14 which is enclosed in a sealed installation part capsule 15. Pipes 16 are brought through suitable connectors 17 in the wall of the capsule to connect up to the christmas tree. A hatch 18 is provided on the top of the capsule. The well head casings terminate in known manner in a connector 110 and an adapter 111. The seals between the casings and the adapter may leak. In embodiments of the present invention, these seals are outside the capsule. The adapter is a solid block which penetrates the capsule wall and contains a master valve 112 which can be operated manually or by remote hydraulic means which are arranged not to interfere with each other.

Figure 2:
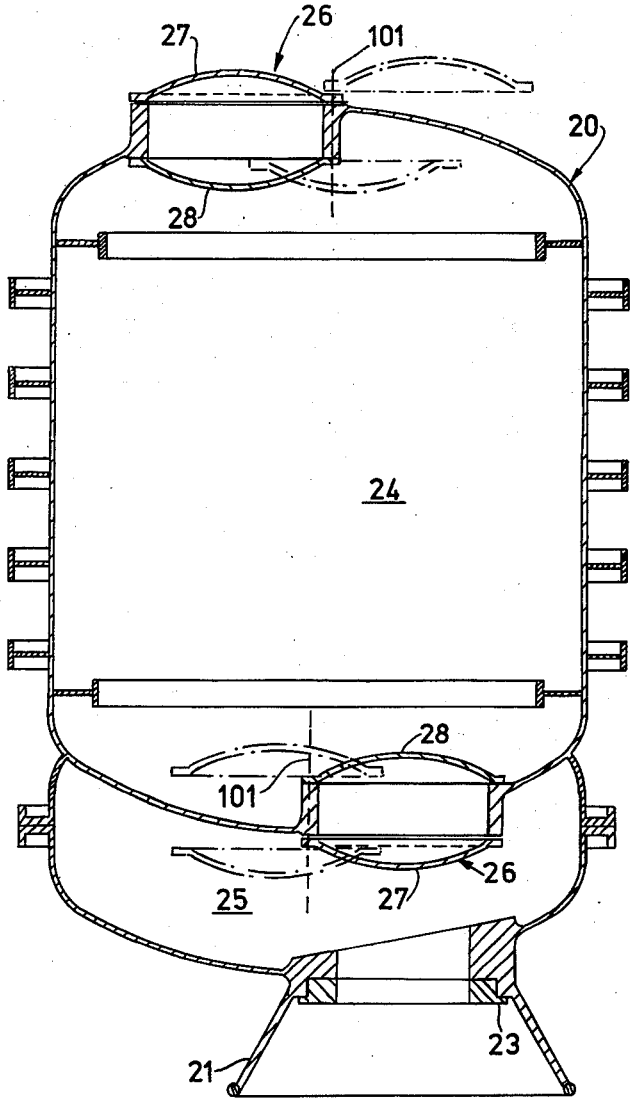
FIG. 2 shows a transit module.

FIG. 2 shows a transit module 20 which can be guided down to the capsule 15 by any of the known means such as guide wires (not shown). At the bottom of this module, there is an entry fairing 21 to receive the hatch 18 and guide a sealing surface 22 around the hatch onto a complementary sealing surface 23 on the module 20.

The module 20 comprises an upper, transit, capsule 24 and a lower chamber which is normally open at its lower end at the fairing 21 but which is sealed by the cooperation of the sealing surfaces to form a third, conjunction, capsule. The chamber will hereinafter be referred to as the capsule 25.

The capsule 24 has double hatches 26 at its lower and upper ends. The upper double hatch is for the entry of personnel and equipment at the sea surface and the lower double hatch is to give access to the conjunction capsule 25. The double hatches are designed with an outer member 27 to resist external pressure and an inner member 28 to resist pressure within the capsule 24; this allows the capsule to be used normally and as a decompression chamber if the capsule by any mishap becomes pressurized whilst containing personnel as might occur if a leak commenced when personnel where in the capsule 15 and the lower double hatch had to remain open to allow them to reenter the capsule 24. The personnel could then seal themselves into the capsule at whatever pressure existed and escape to the surface relying on the air in the capsule 24 and possibly external connectors for enabling support vessels to supply further air when on the surface but before it would be safe to leave the capsule because of insufficient decompression. The members of each double hatch pivot about a single pin 101 parallel to the axis of the hatch.

The hatch 18 can be designed to resist major pressure within the capsule 15 only since the capsule is preferably at full hydrostatic pressure except when the pressure across this hatch is balanced at atmospheric pressure.

The christmas tree 14 projects through the capsule 15 being rigidly sealed to the bottom of the capsule and being slidably sealed in a port 31 at the top of the capsule to allow for relative expansion and to allow for connection of wireline or other auxiliary units 110 (FIG. 8) which would be at the top of the tree. The form of this sliding seal is a rigid collar 32 fast to the port 31 within which collar there is a piston 33 which can be used as a hydrostatic bearing and as a jack to lift elements off the tree of their seatings prior to being removed.

FIG. 3 shows a circuit diagram of means for regulating water pressures. This figure is rather complex due to the large amount of designed redundancy and it is thought best described by an explanation of how it is used. First it is to be assumed that the three capsules 15, 24 and 25 (shown in this figure in broken lines) are filled, capsule 24 with air at atmospheric pressure and the other two capsules with water at external pressure. A pressure bleed 51 is connected to an expansion tank 52 by means of valves 53. The pressure bleed is provided in or bypassing the lower double hatch 26. The expansion tank is a pressure vessel and initially its pressure rises as sensed by a pressure gauge 54. If there is a leak on the sealing surfaces 22 and 23 the pressure would rise to the external pressure. However normally the pressure rise will be limited indicating the absence of any leak and the expansion tank can be vented to the transit capsule pressure by valves 55. The double hatch can now be opened and access gained to the conjunction capsule 25 to enable flexible connections 56 to be made to the capsule 15 through or by-passing the hatch 18. One of these connections is a pressure bleed and this again is routed by the valves 53 to the expansion tank 52 except that the initial flow is bypassed by valves 57 through a sight glass 58 so that the nature of the flow can be observed and possibly by valves 59 to analytical apparatus 60. If the flow is oil or gas, it is possible to flush any remaining oil or gas from the capsule 15 by pumping water through the other of the flexible connections 56 to an outlet 61 below the expected lowest level of gas or oil by a power driven pump 62 or a hand driven pump 63. This oil or gas would result from a leakage from the well head installation and can be severely limited by means 65 which comprises any one or combination of an oil detector, a gas detector, a differential pressure detector, a pressure relief valve and a frangible diaphragm. This means is disposed in the upper part of the capsule 15 which is so arranged as to provide an oil and gas catchment area around the means. Any detectors used in the means are arranged to prevent further leakage by closing off the well head either by direct mechanical operation or by electrical or hydraulic connections. Preferably the means, or some of it, is disposed to be accessible for closing off purposes from the conjunction capsule. If a pressure relief valve or diaphragm is used, a valve 66 operable from within the capsule 25 is used to isolate the relief valve or diaphragm from the external pressure to allow the pressure relief valve or diaphragm to be serviced. The water which is pumped through the outlet 61 is drawn from a sea connection or possibly from the tank 52 and discharged through another sea connection 68 or a pressure relief valve in the means 65; if oil pollution is to be minimized, it is possible to store the flushed oil in the tank 52 or another tank. In cases where it is impossible to limit the amount of oil leakage, it would be possible to have a diving-bell-like collector to receive any oil coming from the sea connection 68. After all the oil and gas has been flushed out, the pressure in the capsule can be reduced as described in relation to capsule 25 and the hatch opened. Access can then be gained to the well head installation. Since this is still immersed in water which can be 15 feet deep, it is necessary to have shallow water diving support means, i.e., an air supply system including a compressor 102 (FIG. 4) so that the personnel do not have to suck air against the pressure head of the water in the capsule 15. Each person has a demand valve in his breathing equipment to reduce the air pressure to that required at this working depth. Since even if the capsule 15 becomes pressurized whilst occupied, the pressures in the other capsules will increase by the same amount, the pressure head generated by the compressor does not have to be large. The compressor 102 draws in air from the transit capsule and delivers it to a reservoir 103 controlled by a settable relief valve 104 and thence to a breathing manifold 105 through filters 106 and carbon dioxide absorbing means 107. The pressure in this manifold is controlled by a valve 108. Suitable connecting points 109 for drawing off air are provided on the manifold.

FIG. 3 also illustrates flexible connections 69 which can be used to flush equipment within the capsule 15 if required pressure gauges 70 and external connections 71 to enable the capsule 24 to be used as a decompression chamber or diving bell.

So far it has been assumed that the pressure in the capsule 25 can be reduced. The only reason for the pressure in the capsule 25 not to reduce is a leak on the sealing surfaces 22 and 23. One of these surfaces contains a compressible seal 81 which is arranged to be compressed sufficiently for the surfaces 22 and 23 to limit the amount of leakage if the seal 81 fails. The module 20 has a rotatable collar 82 having projections 83 for gripping in T-shaped slots 84 in a ring 72 containing the surface 22 and removing the ring 72 to the surface along with the module 20. At the surface the sealing surfaces can be rectified possibly by replacing the ring 72 which has compressible seals 85 on its lower surface. When the ring 72 has been rectified or replaced it can be brought down on the module 20 and the lower surface sealed. The seals on the lower surface are rendered permanent by sealants and/or inhibitors injected through ducts 86 (which can in turn be sealed by plugs) and this time the ring 72 should give a good seal so that the capsule 25 can be reduced in pressure.

Various functions can be performed from maintenance up to the erection of the christmas tree and making external connections. When the capsule is initially installed using divers or diving bells, it may consist of the bare shell which is attached by the divers to the well head casings, the christmas tree not yet being installed. The holes in the shell such as the port 31 and ports 90 (FIG. 6) for the entry of the pipelines are blanked off from the outside by removable cover plates 91 whose securing means 92 are access accessible from the inside of the shell. These cover plates are arranged so that even in the absence of the securing means the external pressure will cause the cover plates to make a seal with the rest of the shell. Thus the shell immediately after installation can be used to provide a safe working environment for personnel to erect the christmas tree. When a new part of the christmas tree is to brought within the shell, it is possible to bring down the new part within the transit capsule as in the prior art. However because of the low depressurization time required, it is possible for personnel from the transit capsule to release the securing means of a plate over a port 90, buoy the cover plate by means of a hawser 93 and an eyebolt 94 and attach a haul down hawser 95 to an eyebolt 96. They can then return to, and seal themselves inside the transit capsule and repressurize the capsule 15 so that the cover plate is expelled from its seating and can be recovered by a support ship. A new part and the cover plate or, for example, a pipe 97 (FIG. 7) can then be arranged on the hawser 95 and the hawser drawn in by a winch in the capsule 25 operated from within the capsule 24 so that the cover plate or pipe flange is drawn tight back on its seating with the new part within the capsule 15. The personnel can then reduce the pressure in the capsule 15 to regain access thereto and secure the pipe flange or to resecure the cover plate and fit the new part.

Some parts of the well head installation may be connected by flexible leads to the christmas tree and be removably secured within the capsule 15 so that they can be drawn up into the transit capsule for maintenance in a dry environment. Such a part is a control panel 119 (FIG. 1).

For subsea installations of a simple nature such as a pipe line valve 120 (FIG. 9), it is possible to dispense with a separate capsule permanently enclosing it and to have the valve normally exposed to the open sea and enclose it in a conjunction capsule for servicing it.

After the maintenance or installation function is completed the personnel return to the transit capsule sealing the hatches behind them and repressurizing the equipment part and conjunction capsules. The transit capsule then returns to the sea surface.

I claim:

1. A method of working underwater comprising descending in an air-filled transit capsule at atmospheric pressure to a permanently installed part of an underwater installation on which a function is to be performed and which is at a depth where the external pressure is greater than safe for working without the need for lengthy decompression, said part and said capsule having complementary means to form another capsule when said part and said transit capsule are joined, joining the transit capsule in fluid-tight sealing relationship to said installation part so as to have two capsules, the transit capsule filled with air at atmospheric pressure and said another capsule filled with water initially at said external pressure, reducing the pressure of the water in said another capsule to atmospheric by connecting said another capsule to the atmospheric pressure in the transit capsule, gaining access to, and performing the desired function on, the installation part whilst it is surrounded with water at atmospheric pressure, returning to the transit capsule, repressurizing said another capsule by disconnecting it from the atmospheric pressure in said transit capsule while connecting said another capsule with sea water at said external pressure, and returning to the surface in said transit capsule.

2. A method according to claim 1 wherein said installation is enclosed in an installation part capsule, and said transit capsule includes a conjunction part, and said another capsule is formed by joining of the conjunction part of the transit capsule and the installation part capsule.

3. A method of working underwater comprising descending in an air-filled transit capsule at atmospheric pressure to a water-filled capsule enclosing a permanently installed part of an underwater installation on which a function is to be performed, said water-filled capsule being at a depth where the external pressure is greater than safe for working without the need for lengthy decompression, the two capsules having complementary means for forming a third conjunction capsule when said two capsules are joined, joining the two capsules in fluid-tight sealing relationship and so forming said third conjunction capsule between said transit capsule and said installation part capsule, establishing the pressure in the part whilst its capsule is filled with water at atmospheric by connecting said capsules to the atmospheric pressure in said transit capsule, gaining access to, and performing the desired function on, the installation part whilst its capsule is filled with water at atmospheric pressure, returning to the transit capsule, repressurizing the conjunction and installation part capsules by disconnecting them from atmospheric pressure in the transit capsule while connecting them with sea water at said external pressure, and returning to the surface in the transit capsule.

4. The method according to claim 3 wherein the installation part capsule is repressurized before the conjunction capsule.

5. A method of working underwater according to claim 3 to perform a function involving passing a part through a wall of the installation part capsule, wherein the capsule enclosing the installation part is reduced in pressure, a cover plate is released, the personnel return to the transit capsule, the installation part capsule is repressurized, the cover plate is removed with a hawser attached, the part to be passed is attached to the hawser and drawn down to the installation part capsule to form a new seal therewith to enable the pressure within the installation part capsule to be reduced to atmospheric, the installation part capsule is so reduced in pressure, and the personnel working at atmospheric pressure underwater secure the so passed part.

* * * * *